US009188413B2

(12) United States Patent
McLean et al.

(10) Patent No.: US 9,188,413 B2
(45) Date of Patent: Nov. 17, 2015

(54) SHAPED CHARGE CASING

(75) Inventors: Stephen James McLean, Sevenoaks (GB); Douglas Kirkpatrick, Sevenoaks (GB); Nigel Chapman, Crockenhill (GB)

(73) Assignee: The Secretary of State for Defense, Salisbury, Wiltshire (GB)

( * ) Notice: Subject to any disclaimer, the term of this patent is extended or adjusted under 35 U.S.C. 154(b) by 911 days.

(21) Appl. No.: 12/803,016

(22) Filed: Oct. 12, 2010

(65) Prior Publication Data

US 2014/0060369 A1 Mar. 6, 2014

(30) Foreign Application Priority Data

Nov. 25, 2009 (GB) ..... 0920745.7

(51) Int. Cl.
*F42B 12/10* (2006.01)
*F42B 1/028* (2006.01)

(52) U.S. Cl.
CPC ..... *F42B 12/10* (2013.01); *F42B 1/028* (2013.01)

(58) Field of Classification Search
CPC ..... F42B 12/10; F42B 1/028
USPC ..... 102/476, 306–310, 331
See application file for complete search history.

(56) References Cited

U.S. PATENT DOCUMENTS

| | | | | | |
|---|---|---|---|---|---|
| 2,972,948 | A | * | 2/1961 | Kray | 102/476 |
| 2,984,307 | A | * | 5/1961 | Barnes | 175/4 |
| 3,388,663 | A | * | 6/1968 | Wyman, Sr. et al. | 102/476 |
| 3,613,582 | A | * | 10/1971 | Levamaki et al. | 102/306 |
| 3,777,663 | A | * | 12/1973 | Brown | 102/331 |
| 4,099,464 | A | * | 7/1978 | Cross et al. | 102/331 |
| 4,109,576 | A | * | 8/1978 | Eckels | 102/307 |
| 4,114,537 | A | * | 9/1978 | Brown | 102/24 |
| 4,481,886 | A | * | 11/1984 | Brattstrom et al. | 102/476 |
| 4,487,130 | A | * | 12/1984 | Brattström et al. | 102/476 |
| 4,901,619 | A | * | 2/1990 | Sassmannshausen et al. | 86/20.12 |
| 4,982,665 | A | * | 1/1991 | Sewell et al. | 102/306 |
| 5,166,469 | A | * | 11/1992 | Kerdraon et al. | 102/210 |
| 5,191,169 | A | * | 3/1993 | Hu | 102/476 |
| 5,282,423 | A | * | 2/1994 | Sikorski et al. | 102/431 |
| H1504 | H | | 12/1995 | Crabtree | |
| H001504 | H | * | 12/1995 | Crabtree | 102/476 |
| 5,509,356 | A | * | 4/1996 | Renfro | 102/307 |
| 5,925,845 | A | * | 7/1999 | Tompkins et al. | 102/476 |
| 5,936,184 | A | * | 8/1999 | Majerus et al. | 89/1.13 |
| 6,840,178 | B2 | * | 1/2005 | Collins et al. | 102/476 |
| 7,011,027 | B2 | * | 3/2006 | Reese et al. | 102/307 |
| 8,037,829 | B1 | * | 10/2011 | Waddell et al. | 102/306 |
| 2003/0183113 | A1 | * | 10/2003 | Barlow et al. | 102/476 |
| 2011/0239888 | A1 | * | 10/2011 | Waddell et al. | 102/307 |

FOREIGN PATENT DOCUMENTS

| | | |
|---|---|---|
| DE | 2242930 | 3/1974 |
| EP | 0185150 | 6/1986 |

OTHER PUBLICATIONS

Search Report dated Jul. 2, 2010 in connection with GB0920745.7.

* cited by examiner

*Primary Examiner* — Joshua Freeman
(74) *Attorney, Agent, or Firm* — Dean W. Russell; Kilpatrick Townsend & Stockton LLP

(57) ABSTRACT

A shaped charge casing 1 designed to be nested to reduce overall volume, which benefits storage or carriage. A lid portion 5 is connected at 8 to a body portion 9 by means of a screw thread. A shaped charge liner 12 can be positioned onto lip 11. The lid portion 5 and body portion 9 can be separated to allow filling or unpacking of explosive material.

20 Claims, 1 Drawing Sheet

SHAPED CHARGE CASING

FIELD OF INVENTION

This invention relates to shaped charge cases, in particular shaped charge cases that can be nested and more specifically hand stemmed shaped charge cases that are nestable to reduce volume for carriage without detriment to the performance of the casing.

BACKGROUND TO THE INVENTION

A shaped charge is an explosive charge shaped to focus the effect of the explosive's energy. A typical device consists of a solid cylinder of explosive with a metal-lined conical hollow in one end and a central detonator at the other end contained within a casing. The enormous pressure generated by the detonation of the explosive drives the liner contained within the hollow cavity inward to collapse upon its central axis. The resulting collision forms and projects a high-velocity jet of metal forward along the axis.

Shaped charges are frequently used as warheads in anti-tank missiles (guided and unguided) and also gun-fired projectiles (spun and unspun), rifle grenades, mines, bomblets, torpedoes and for various explosive disposal purposes. The shaped charge is held within a casing for safe storage and to aid the effectiveness of the charge on detonation.

Previous use of shaped charge casings has involved the charge casing being packed with explosive material either manually (hand stemmed) or by machine and assembled for storage or use. If the user wishes to carry several shaped charge casings on his person, it means a considerable volume is taken up and thus there is less space available for other equipment to be taken. It would be advantageous then to provide a shaped charge casing designed to reduce the overall volume for carriage or storage. Prior art such as EP0185150 shows the principal of stacking warheads to save space. U.S. Pat. No. 4,114,537 discloses a multipart trenching charge case having upper and lower parts which can be nested. In this charge the upper part of the casing provides an explosive compartment and the lower part of the casing provides the required stand off distance.

SUMMARY OF INVENTION

It is an object of the present invention to provide a shaped charge casing whereby multiple such charge casings can be nested within each other so that they do not require a high volume for storage or carriage.

Accordingly the present invention provides a shaped charge casing comprising a body portion provided with means for mounting a shaped charge liner and a cooperating lid portion together defining an explosive compartment wherein the shapes of the body portion and the lid portion are configured to enable a plurality of casings to be nested.

The two part design is simple, easy to use, removes the possibility of the loss or failure of a small component and keeps manufacturing costs to a minimum. The design of the invention allows several lid and body portions to be nested in succession. Where nesting is used here to mean a part of one body fits inside another body so as to save volume. The same also applies to lids being nested. The body portion of the shaped charge has an internal lip to hold the shaped charge liner in place whilst explosive material such as PE4 can be packed onto the liner. Different liners can be simply inserted without changing other parts of the charge. A tapered shape design of the body and lid portions makes nesting easier.

The lid portion may be shaped as a cone. Preferably a detonator holding means can be incorporated by the lid being designed in the shape of an inverted funnel. The narrow neck of the lid can hold in position a standard demolition detonator (electric or plain) or a detonating cord booster. The detonator is simply inserted and will remain in place when subjected to normal stresses for an emplaced explosive charge. Providing chamfered edges on the lid makes it easier for stacking one lid onto another. The body of the shaped charge may be designed as a truncated cone. The tapered shape of the body reduces the distance between the bulk of the explosive and the target i.e. the standoff distance, maximizing blast damage. This is advantageous when explosive blast damage is required as well as shaped charge effects. The shaped charge being in two parts allows the easy packing and removal of explosive material within the lid and the body. The tapering encourages homogenous filing with no air gaps next to the liner, which ensures efficient jet formation. The combined shape of the body and lid portions is conducive to rapid, high quality stemming and simplifies manual stemming of the charge. The external step provided on the outside of the body also enables easy stacking of one body on top of another, with no high-stress points that might cause deformation.

The lid and body portions are connected together with attachment means such as clips. If the casing is based on a cylindrical configuration then the attachment means is preferably a cooperating screw thread. This has the advantage that when screwing together of the body and lid portions, this ensures that the explosive is compressed to ensure efficient formation of the shaped charge jet.

The lid and body portions may be formed of polymeric material. Preferably the lid and body of the shaped charge will be comprised of structural polyurethane foam. This is a light-weight material that is easy to manufacture at low cost. This material is considered non-fragmenting which allows a very low weapon danger area when compared with other commonly used shaped charge casing materials. It is also structurally strong enough to allow stacking and carriage of several shaped charges without the additional need for protective packaging. Typically the user will carry the stacked charges in a back pack where volume is limited, allowing other equipment to be packed. Other materials such as syntactic foam, thin wall, or low resin content reinforced polymers are alternatives that can be used.

A further benefit of the invention is that the liner can be assembled with the casing for nesting, this facilitates quicker hand stemming for the user.

BRIEF DESCRIPTION OF THE DRAWINGS

In order that the invention might be more fully understood, an embodiment thereof will now be described, with reference to the accompanying drawings, in which.

DETAILED DESCRIPTION

Figures 1, 2:
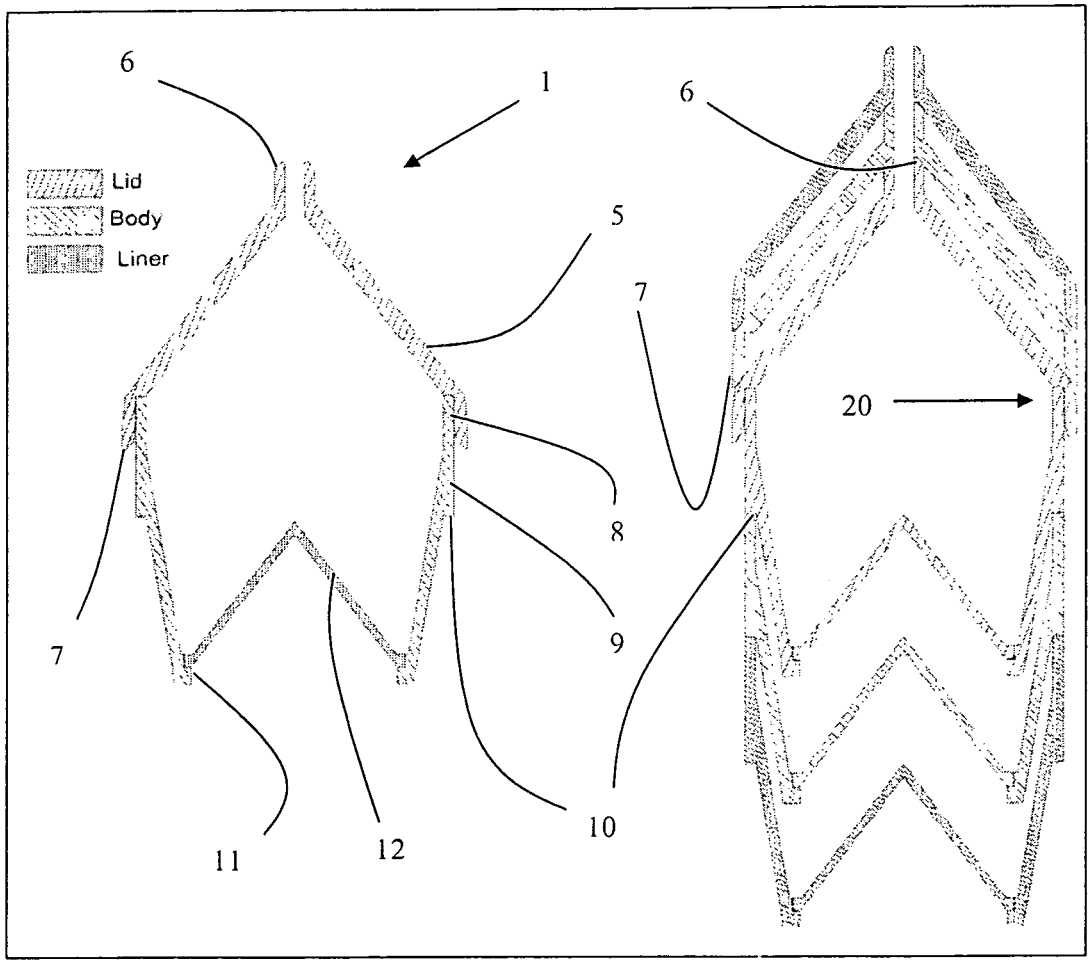
FIG. 1 illustrates a cross sectional view of a shaped charge casing in accordance with the invention.
FIG. 2 illustrates a cross sectional view of three shaped charge casings in a nested formation.

FIG. 1 shows a cross sectional view of a nestable shaped charge casing 1 as assembled. A key is provided to distinguish the components of FIG. 1 only. A lid portion 5 is shaped as an inverted funnel and edges 6 and 7 are chamfered to enable several lid portions to be stacked efficiently (see FIG. 2). The lid portion 5 is connected at point 8 to a body portion 9. The means of connection is a screw thread. The body portion 9 has a step 10 to enable several body portions to be nested efficiently (see FIG. 2). The body portion 9 also has a lip 11 to allow a shaped charge liner 12 to be fitted.

FIG. 2 shows a cross sectional view of several nestable shaped charge casings. The nestable shaped charge casing 20 is positioned centrally and is assembled. Two further lid portions are shown stacked above and two further body portions are shown stacked beneath shaped charge casing 20. The chamfered edges 6 and 7 and step 10 allow the lid and body portions to mate effectively.

Assembled shaped charge casing 20 is optionally prepacked with explosive filling (not shown). The remaining shaped charge casings are packed and assembled as required. This means that explosive material does not have to be unpacked until needed, making storage easier and maintaining shelf life of the explosive. The current embodiment can hold a quantity of 1 lb of PE4 but a person skilled in the art will appreciate that by scaling the size and shape of the embodiment to accommodate different quantities of explosive and changing the shape of the liner different charge effects can be achieved. Other user filled shaped charge systems can also benefit from this stacking construction are the Miznay-Schardin plates, Explosively Formed Projectile, focussed fragments or configured as a linear system such as a truncated prism cross-section.

The invention claimed is:

1. A shaped charge casing comprising a first body portion and a cooperating first lid portion together defining an explosive compartment, wherein the shapes of the first body portion and the first lid portion are configured to enable (i) at least a second body portion shaped in the same manner as the first body portion to be nested onto the first body portion such that a first shaped charge liner can be mounted within the first body portion and a second shaped charge liner can be mounted within the second body portion and (ii) at least a second lid portion shaped in the same manner as the first lid portion to be nested onto the first lid portion.

2. A shaped charge casing according to claim 1 wherein both the first body portion and the first lid portion comprise tapered wall sections.

3. A shaped charge casing according to claim 1 wherein the first lid portion incorporates a detonator holding means.

4. A shaped charge casing according to claim 1 wherein the first body portion has an external step.

5. A shaped charge casing according to claim 1 wherein the first body portion is shaped as a truncated cone.

6. A shaped charge casing according to claim 5 wherein the first lid portion is shaped as a cone.

7. A shaped charge casing according to claim 1 wherein attachment means are provided such that the first lid portion can be attached to the first body portion.

8. A shaped charge casing according to claim 7 wherein the attachment means is a cooperating screw thread provided on both the first body and first lid portions.

9. A shaped charge casing according to claim 1 wherein the first body and first lid portions are comprised of Polymeric material.

10. A shaped charge casing according to claim 1 wherein the first body and first lid portions are comprised of Polyurethane foam.

11. A shaped charge casing according to claim 1 further comprising the first shaped charge liner mounted in the first body portion.

12. A shaped charge casing according to claim 1 in which the first body portion comprises a lip onto which the first shaped charge liner is mounted.

13. A shaped charge casing according to claim 1 in which the first body portion comprises a step abutting the second body portion when the second body portion is nested onto the first body portion.

14. A shaped charge casing according to claim 1 in which the first lid portion comprises a chamfered edge.

15. A set of first and second shaped charge casings in which:

a. the first shaped charge casing comprises (i) a first body portion, (ii) a first lid portion cooperating with the first body portion as deployed to define a first explosive compartment, and (iii) a first shaped charge liner;

b. the second shaped charge casing comprises (i) a second body portion, (ii) a second lid portion cooperating with the second body portion as deployed to define a second explosive compartment, and (iii) a second shaped charge liner;

c. prior to deployment (i) the first and second body portions are configured to be nested with the first shaped charge liner mounted in the first body portion and the second shaped charge liner mounted in the second body portion, (ii) the first and second lid portions are configured to be nested, and (iii) the first body portion and the first lid portion are configured to abut; and d. as deployed (i) the first body portion is attached to the first lid portion and (ii) the second body portion is attached to the second lid portion.

16. A set of first and second shaped charge casings according to claim 15 in which the first body portion comprises a first lip onto which the first shaped charge liner is mounted.

17. A set of first and second shaped charge casings according to claim 16 in which the second body portion comprises a second lip onto which the second shaped charge liner is mounted.

18. A set of first and second shaped charge casings according to claim 15 in which the first body portion comprises a step configured such that, prior to deployment, it abuts the second body portion to which the first body portion is nested.

19. A set of first and second shaped charge casings according to claim 15 in which the first lid portion comprises a chamfered edge.

20. An assembly of shaped charge casings having components nestable prior to deployment, the assembly comprising:

a. a first shaped charge casing comprising (i) a first body portion, (ii) a first lid portion cooperating with the first body portion as deployed to define a first explosive compartment, and (iii) a first shaped charge liner;

b. a second shaped charge casing comprising (i) a second body portion, (ii) a second lid portion cooperating with the second body portion as deployed to define a second explosive compartment, and (iii) a second shaped charge liner; and in which (i) the first and second body portions are nested with the first shaped charge liner mounted in the first body portion and the second shaped charge liner mounted in the second body portion, (ii) the first and second lid portions are nested, and (iii) the first body portion and the first lid portion abut.

* * * * *

UNITED STATES PATENT AND TRADEMARK OFFICE

CERTIFICATE OF CORRECTION

PATENT NO. : 9,188,413 B2
APPLICATION NO. : 12/803016
DATED : November 17, 2015
INVENTOR(S) : Stephen James McLean et al.

It is certified that error appears in the above-identified patent and that said Letters Patent is hereby corrected as shown below:

On the Title Page:

Item (73) "The Secretary of State for Defense" should be corrected to read -- The Secretary of State for Defence --

Signed and Sealed this
Sixteenth Day of February, 2016

Michelle K. Lee

Michelle K. Lee
*Director of the United States Patent and Trademark Office*